US010856721B2

(12) United States Patent
Marew et al.

(10) Patent No.: US 10,856,721 B2
(45) Date of Patent: Dec. 8, 2020

(54) FLOOR MAT APPARATUS

(71) Applicants: Ayenew Marew, Lancaster, PA (US); Bruke Alemayew, Lancaster, PA (US)

(72) Inventors: Ayenew Marew, Lancaster, PA (US); Bruke Alemayew, Lancaster, PA (US)

( * ) Notice: Subject to any disclaimer, the term of this patent is extended or adjusted under 35 U.S.C. 154(b) by 157 days.

(21) Appl. No.: 16/133,534

(22) Filed: Sep. 17, 2018

(65) Prior Publication Data

US 2019/0082928 A1 Mar. 21, 2019

Related U.S. Application Data

(60) Provisional application No. 62/559,584, filed on Sep. 17, 2017.

(51) Int. Cl.
*A47L 23/26* (2006.01)
*A47L 11/40* (2006.01)

(52) U.S. Cl.
CPC ..... *A47L 23/266* (2013.01); *A47L 11/4013* (2013.01); *A47L 23/263* (2013.01)

(58) Field of Classification Search
CPC .. A47L 23/236; A47L 23/266; A47L 11/4013; A47L 11/4025
See application file for complete search history.

(56) References Cited

U.S. PATENT DOCUMENTS 2,463,153 A * 3/1949 Conklin ..... A47L 23/263 15/36
2,533,781 A * 12/1950 Fallowfield, Jr. ..... A47L 23/263 15/36
3,203,020 A * 8/1965 Merkel ..... A47L 23/263 15/36
3,348,252 A * 10/1967 Lightowler ..... A47L 23/263 15/36
3,611,472 A * 10/1971 Kayser ..... A01K 1/015 15/302
4,014,060 A * 3/1977 Taylor ..... A47L 23/263 15/36
4,280,244 A * 7/1981 Spirig ..... A47L 23/263 15/36

(Continued)

FOREIGN PATENT DOCUMENTS

CH 149357 A * 9/1931 ..... A47L 23/263
DE 10129435 A1 * 3/2002 ..... A47L 23/263

(Continued)

OTHER PUBLICATIONS

Machine translation of FR-2184430-A1 (Year: 1973).*

(Continued)

*Primary Examiner* — Michael McCullough
(74) *Attorney, Agent, or Firm* — Barley Snyder

(57) ABSTRACT

An improved floor mat apparatus is a low profile, rectangular, shoe cleaning apparatus that has an inner volume with two spaced apart rollers mounted within the inner volume that an elongated mat with the ends joined together forming a continuous loop, travels around. A motor turns a first roller and the second roller adjusts to remove slack to tighten the mat. The top surface of the housing is open to expose the mat for cleaning shoes upon. When the mat becomes dirty, the rollers turn via a button located on a panel situated adjacent to one end of the mat and a removable collection chamber at one end of the mat collects debris and helps remove dirt from the mat via a vibrator and brush.

15 Claims, 5 Drawing Sheets

(56) References Cited

U.S. PATENT DOCUMENTS

| | | | | |
|---|---|---|---|---|
| 4,951,345 | A * | 8/1990 | Nappi, Sr. | A47L 23/263 15/302 |
| 5,771,528 | A * | 6/1998 | Nappi, Sr. | A47L 23/263 15/301 |
| 6,406,549 | B1 * | 6/2002 | Berg | A47L 23/263 134/1 |
| 8,161,590 | B2 * | 4/2012 | Feeg | A47L 23/263 15/112 |
| 8,631,533 | B1 * | 1/2014 | Gulian | A61L 2/10 15/36 |
| 9,101,260 | B2 * | 8/2015 | Desu-Kalyanam | A47L 23/263 |
| 9,848,755 | B2 * | 12/2017 | Siegel | A47G 27/0206 |
| 2004/0078909 | A1 * | 4/2004 | Coppa | A47L 23/266 15/104.92 |
| 2016/0345800 | A1 * | 12/2016 | MacIntyre | A46B 13/02 |
| 2017/0128606 | A1 * | 5/2017 | Jackson | A47L 23/266 |
| 2018/0126019 | A1 * | 5/2018 | Prieto Andreu | A47G 27/00 |

FOREIGN PATENT DOCUMENTS

| | | | | |
|---|---|---|---|---|
| FR | 1111058 | A * | 2/1956 | A47L 23/263 |
| FR | 2184430 | A1 * | 12/1973 | A47L 23/263 |
| FR | 2452909 | A1 * | 10/1980 | A47L 23/263 |
| GB | 1094259 | A * | 12/1967 | A47L 23/263 |

OTHER PUBLICATIONS

Machine translation of FR-1111058-A (Year: 1956).*
Machine translation of CH-149357-A (Year: 1931).*
Machine translation of FR-2452909-A1 (Year: 1980).*

* cited by examiner

FLOOR MAT APPARATUS

CROSS-REFERENCE TO RELATED APPLICATION

The present application is related to and claims priority from prior provisional application Ser. No. 62/559,584, filed Sep. 17, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of floor mats and more specifically relates to an improved floor mat apparatus.

2. Description of the Related Art

With the type of flooring that is used in modern homes, dirt and various types of debris that tends to collect in the treads of shoes and then is carried and deposited onto floors. This dirt accumulation is very noticeable as well as being unpleasant to walk on. With hard floors, dirt particles can be heard and felt as they crunch beneath the feet of those walking upon it, and when the flooring is carpeted, dirt accumulates quickly and discolors the carpet making it unsightly. This applies to most vehicles as well. In addition to this unpleasantness, the accumulation of dirt contaminates the surfaces with bacteria and/or the contamination is buried within the fibers of the carpet making it unsafe for small children to contact. In order to reduce the contamination buildup, rugs or mats are used in entry ways, doorways, or floorboards of vehicles to collect the debris. This is still only marginally effective as long as the mats or rugs remain relatively clean. The rugs or mats must be cleaned frequently or they just add to the problem. An antimicrobial solution to the problem that also reduces the frequency that floor mats need to be cleaned is needed.

Ideally, floor mats should provide disinfection and a reduced frequency for required cleaning, and yet, would operate reliably and be manufactured at a modest expense. Thus, a need exists for a reliable improved floor mat apparatus to avoid the above-mentioned problems.

BRIEF SUMMARY OF THE INVENTION

In view of the foregoing disadvantages inherent in the known floor mat art, the present invention provides a novel improved floor mat apparatus. The general purpose of the present invention, which will be described subsequently in greater detail, is to provide disinfection and a reduced frequency for required cleaning.

The improved floor mat apparatus preferably comprises a main body including a bottom wall, two side walls spaced from one another and attached to and extend from the bottom wall, and two end walls attached to and extending from opposite ends of the bottom wall which extends between the two spaced side walls. The bottom wall, the two side walls, and the two end walls define the interior volume of the improved floor mat.

A first elongated roller is rotatably and releasably connected between the two side walls at respective proximal end portions and a second elongated roller is rotatably and releasably connected between the two side walls at respective distal end portions.

An electric motor is located within the interior volume and is adapted to rotate the first elongated roller. A power source is located within the interior volume and is adapted to provide electric power to the electric motor.

An endless mat having a top surface formed from a material adapted to frictionally remove and removably retain dirt and debris that is transferred from footwear is formed as a continuous loop having a circular length. The endless mat is formed having a substantially constant width along the length and is adapted to wrap around and be rotated by the first and second elongated rollers.

A collection tray having a bottom wall and two side walls are spaced from one another and are attached to and extend from the bottom wall and the two end walls that are attached to and extend from opposite ends of the bottom wall extending between the two spaced side walls, and the top wall attached to one of the two end walls and to the two side walls and extends a distance to allow a space between a leading edge and the other of the two end walls, define an interior volume adapted for catching and collecting dirt and debris.

An elongated primary brush has a length substantially equal to the width of the endless mat and is attached along a length of the leading edge of the top wall of the collection tray and is adapted to contact the top surface of the endless mat as it is rotated by the first and second rollers to thereby frictionally remove any dirt and debris retained upon the top surface of the endless mat such that the removed dirt and debris would fall into and be removably retained within the interior volume of the collection tray.

The collection tray is sized and adapted to be removably placed adjacent to and underneath the first elongated roller such that the collection tray can be removed, dirt and debris removed from the collection tray, and then placed back into place adjacent to and underneath the first elongated roller. An elongated secondary brush is spaced from the elongated primary brush and has a length substantially equal to the width of the endless mat and also is attached along the length of the interior surface of the bottom wall of the collection tray so that it contacts the top surface of the endless mat as it is rotated by the first and second rollers to frictionally remove dirt and debris still retained upon the top surface of the endless mat after being brushed by the elongated primary brush. The design and operation removes dirt and debris causing it to fall into and be removably retained within the interior volume of the collection tray.

A removable panel is removably connected to the top edge portions of the two side walls at the respective distal end portions that is adapted to cover and protect the interior volume of the main body in proximity to the first roller member and the collection tray while facilitating removal and replacement of the collection tray. The removable panel is further pivotally connected to one of the two end walls located adjacent to the proximal end portions of the two side walls.

A vibrator electrically connected to the power source is located within the interior volume adjacent to the collection tray and is adapted to vibrate the collection tray when the first and second rollers are rotating the endless mat such that dirt and debris moves with the collection tray away from the endless mat.

An ultraviolet light strip electrically connected to the power source has a length substantially equal to the width of the endless mat and is located within the interior volume and attached to the inner surface of the bottom wall of the main body and adapted to sterilize the top surface of the endless mat. The ultraviolet light strip may be formed as a light emitting diode light strip.

A control panel attached to a top edge portion of one of the two side walls is electrically connected to the power source and is adapted to turn on and off the motor and control the speed of rotation. The power source may be formed as a rechargeable battery.

An indicator light attached to a top edge portion of one of the two side walls is electrically connected to the power source and is adapted to indicate when power is being transferred to the motor. The collection tray is preferably formed from a plastic material but may be formed from a cloth material in some embodiments. In embodiments where the collection tray is formed from a cloth material, the material is preferably hypoallergenic and antimicrobial. The main body may be formed having a width of between 16 and 18 inches.

The present invention holds significant improvements and serves as an improved floor mat apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an improved floor mat apparatus, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a floor mats and more particularly to an improved floor mat apparatus as used to improve the disinfection and a reduced frequency for required cleaning of floor mats.

Generally speaking, an improved floor mat apparatus is a low profile, rectangular, shoe cleaning apparatus that has an inner volume with two spaced apart rollers mounted within the inner volume that an elongated mat with the ends joined together forming a continuous loop, travels around. A motor turns a first roller and the second roller adjusts to remove slack to tighten the mat. The top surface of the housing is open to expose the mat for cleaning shoes upon. When the mat becomes dirty, the rollers turn via a button located on a panel situated adjacent to one end of the mat and a removable collection chamber at one end of the mat collects debris and helps remove dirt from the mat via a vibrator and brush.

Figure 1A:
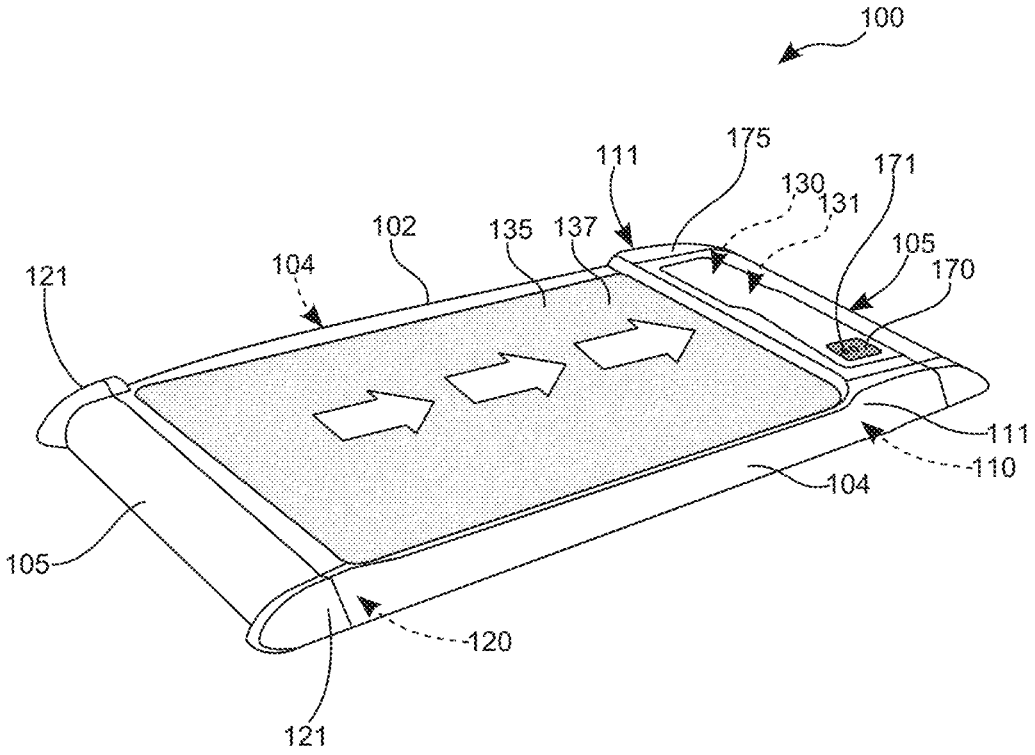
FIG. 1A shows a perspective view illustrating an improved floor mat apparatus according to an embodiment of the present invention.

Referring to the drawings by numerals of reference there is shown in FIG. 1A, a perspective view illustrating improved floor mat apparatus 100 according to an embodiment of the present invention.

Improved floor mat apparatus 100 is versatile and may be used in a variety of locations including automobiles, entry ways, businesses, or other public places. The advantage of improved floor mat apparatus 100 is a reduction in cleaning labor of mats that is well known in the art. It should be understood that different embodiments may include different features or variations of features that are mentioned in this detail and that a single embodiment with specific, detailed features is not intended. For instance, included is control panel 170 with a push button that rotates endless mat 135. The nature of the push button is not detailed but preferably is weather resistant. The function may also include a programmable feature that may operate at different times of the day such that improved floor mat apparatus 100 is auto-cleaned without continuous input from the user, or may operate only with a push of the button on control panel 170.

Improved floor mat apparatus 100 preferably comprises main body 102 having two side wall(s) 104, two end wall(s) 105, bottom wall 103, and an open top area with side wall(s) 104 and end wall(s) 105 curving to form a portion of the top edges. The top portion is mostly open exposing top surface 137 of endless mat 135 for shoe cleaning, and which is mounted on first elongated roller 110 (shown in FIG. 1B) and second elongated roller 120 and rotated via electric motor 125 (shown in FIG. 2 and FIG. 3).

First elongated roller 110 is rotatably and releasably connected between the two side wall(s) 104 at respective proximal end portion(s) 111 and a second elongated roller 120 is rotatably and releasably connected between the two side wall(s) 104 at respective distal end portion(s) 121.

Control panel 170 attached to top edge portion 175 of one of the two side wall(s) 104 is electrically connected to power source 130 and is adapted to turn on and off electric motor 125 (shown in FIG. 2) and control the speed of rotation. Power source 130 may be formed as rechargeable battery 131.

Indicator light 171 attached to top edge portion 175 of one of the two side wall(s) 104 is electrically connected to power source 130 and is adapted to indicate when power is being transferred to electric motor 125.

Figure 1B:
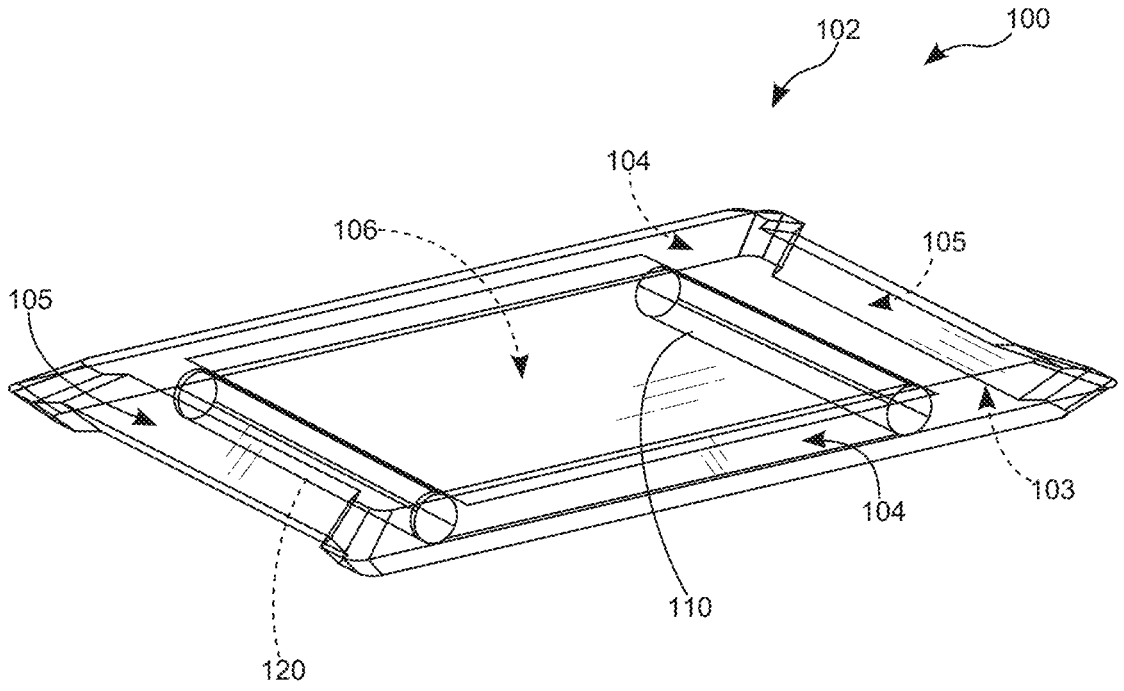
FIG. 1B is a transparent perspective view illustrating the improved floor mat apparatus according to an embodiment of the present invention of FIG. 1.

FIG. 1B is a transparent perspective view illustrating improved floor mat apparatus 100 according to an embodiment of the present invention of FIG. 1.

Improved floor mat apparatus 100 preferably comprises main body 102 including bottom wall 103, two side wall(s) 104 spaced from one another and attached to and extend from bottom wall 103, and two end wall(s) 105 attached to and extending from opposite ends of bottom wall 103 which extends between the two spaced side wall(s) 104. Bottom wall 103, the two side wall(s) 104, and the two end wall(s) 105 define interior volume 106 of improved floor mat apparatus 100. Main body 102 may be formed having a width of between 16 and 18 inches.

Figure 2:
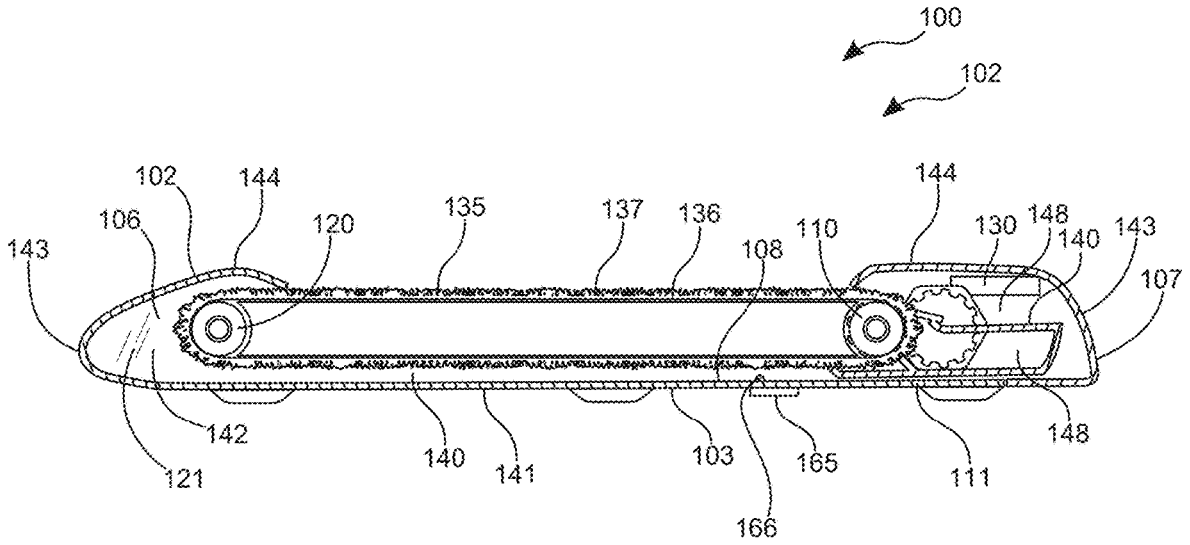
FIG. 2 is a side cutaway view illustrating the improved floor mat apparatus according to an embodiment of the present invention of FIG. 1.

Referring now to FIG. 2, is a side cutaway view illustrating improved floor mat apparatus 100 according to an embodiment of the present invention of FIG. 1.

Endless mat 135 having top surface 137 formed from a material adapted to frictionally remove and removably retain dirt and debris that is transferred from footwear and is formed as continuous loop 136 having a circular length. Endless mat 135 is formed having a substantially constant width along the length and is adapted to wrap around and be rotated by first elongated roller 110 and second elongated rollers 120.

Collection tray 140 having bottom wall 141 and two side wall(s) 142 are spaced from one another and are attached to and extend from bottom wall 141 and the two end wall(s) 143 that are attached to and extend from opposite ends of bottom wall 141 extending between the two spaced side wall(s) 142, and top wall 144 attached to one of the two end wall(s) 143 and to the two side wall(s) 142 and extends a distance to allow a space between leading edge 145 and the other of the two end wall(s) 143, define interior volume 148 adapted for catching and collecting dirt and debris.

Removable panel 107 is removably connected to top edge portion(s) 175 of the two side wall(s) 104 at the respective distal end portion(s) 121 that is adapted to cover and protect interior volume 106 of main body 102 in proximity to first elongated roller 110 and collection tray 140 while facilitating removal and replacement of collection tray 140. Removable panel 107 is further pivotally connected to one of the two end wall(s) 105 located adjacent to proximal end portion(s) 111 of the two side wall(s) 104.

Ultraviolet light strip 165 electrically connected to power source 130 has a length substantially equal to the width of endless mat 135 and is located within interior volume 148 and attached to inner surface 108 of bottom wall 103 of main body 102 and adapted to sterilize top surface 137 of endless mat 135. Ultraviolet light strip 165 may be formed as light emitting diode light strip 166.

Figure 3:
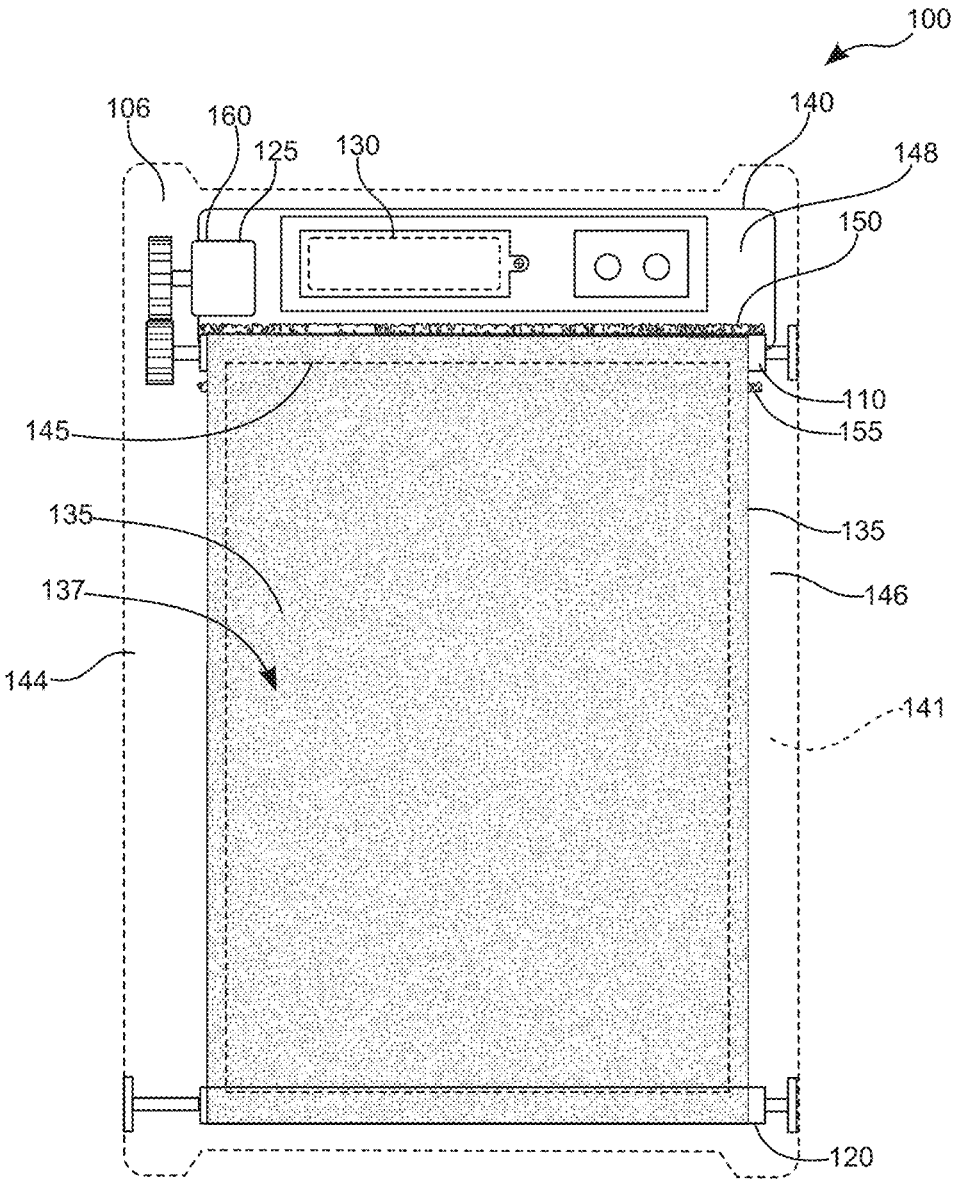
FIG. 3 is an overhead cutaway view illustrating improved floor mat apparatus 100 according to an embodiment of the present invention of FIG. 1.

Referring now to FIG. 3, is an overhead cutaway view illustrating improved floor mat apparatus 100 according to an embodiment of the present invention of FIG. 1.

Electric motor 125 is located within interior volume 106 and is adapted to rotate first elongated roller 110. Power source 130 is located within interior volume 106 and is adapted to provide electric power to electric motor 125.

Collection tray 140 is sized and adapted to be removably placed adjacent to and underneath first elongated roller 110 such that collection tray 140 can be removed, dirt and debris removed from collection tray 140, and then placed back into place adjacent to and underneath first elongated roller 110. Elongated secondary brush 155 is spaced from elongated primary brush 150 and has a length substantially equal to the width of endless mat 135 and also is attached along the length of interior surface 146 of bottom wall 141 of collection tray 140 so that it contacts top surface 137 of endless mat 135 as it is rotated by first elongated roller 110 and second elongated roller 120 to frictionally remove dirt and debris still retained upon top surface 137 of endless mat 135 after being brushed by elongated primary brush 150. The design and operation removes dirt and debris causing it to fall into and be removably retained within interior volume 148 of collection tray 140.

Vibrator 160 is electrically connected to power source 130 is located within interior volume 106 adjacent to collection tray 140 and is adapted to vibrate collection tray 140 when the first 110 and second elongated roller 120 are rotating endless mat 135 such that dirt and debris moves with collection tray 140 away from endless mat 135.

Collection tray 140 is preferably formed from a plastic material but may be formed from a cloth material in some embodiments. In embodiments where collection tray 140 is formed from a cloth material, the material is preferably hypoallergenic and antimicrobial.

Elongated primary brush 150 has a length substantially equal to the width of endless mat 135 and is attached along a length of leading edge 145 of top wall 144 of collection tray 140 and is adapted to contact top surface 137 of endless mat 135 as it is rotated by first elongated roller 110 and second elongated roller 120 to thereby frictionally remove any dirt and debris retained upon top surface 137 of endless mat 135 such that the removed dirt and debris would fall into and be removably retained within the interior volume 148 of collection tray 140.

Figure 4:
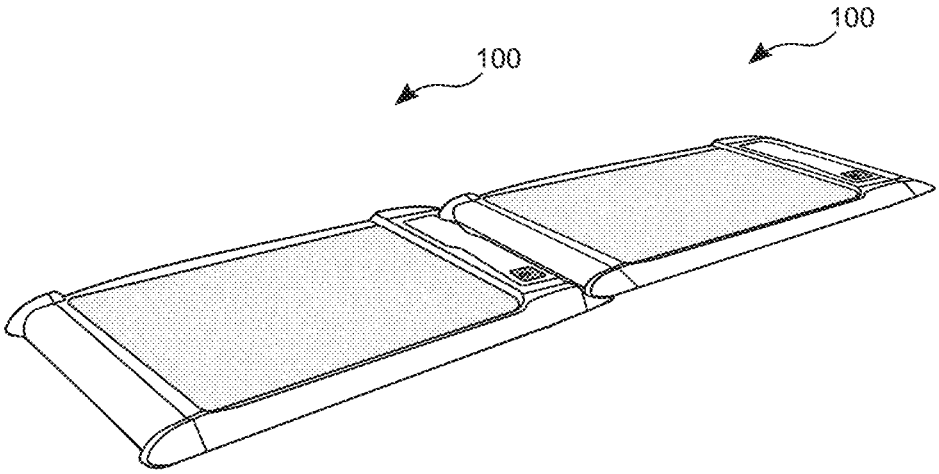
FIG. 4 is a perspective view illustrating two improved floor mat apparatuses joined together according to an embodiment of the present invention of FIG. 1.

Referring now to FIG. 4, showing a perspective view illustrating two improved floor mat apparatuses 100 joined together according to an embodiment of the present invention of FIG. 1.

Improved floor mat apparatus 100 is structured so that multiple improved floor mat apparatuses 100 may be removably attached together for larger areas that require a larger shoe cleaning area such as for commercial purposes or for large entry ways. Any number of improved floor mat apparatuses 100 may be connected linearly and or multiple rows may be utilized with multiple improved floor mat apparatus 100 attached linearly.

Improved floor mat apparatus 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved floor mat apparatus comprising:

a main body including:

a bottom wall;

two side walls;

wherein said two side walls are spaced from one another and are attached to and extend from said bottom wall; and two end walls;

wherein said two end walls are attached to and extend from opposite ends of said bottom wall and extend between said two spaced side walls;

wherein said bottom wall, said two side walls, and said two end walls define an interior volume;

a first elongated roller;

wherein said first elongated roller is rotatably and releasably connected between said two side walls at respective proximal end portions thereof;

a second elongated roller;

wherein said second elongated roller is rotatably and releasably connected between said two side walls at respective distal end portions thereof;

an electric motor;

wherein said electric motor is located within said interior volume and is adapted to rotate said first elongated roller;

a power source;

wherein said power source is located within said interior volume and is adapted to provide electric power to said electric motor;

an endless mat including:

a top surface;

wherein said top surface is formed from a material adapted to frictionally remove and removably retain dirt and debris from footwear placed thereon;

wherein said endless mat is formed as a continuous loop having a length there around;

wherein said endless mat is formed has a substantially constant width along said length thereof; and wherein said endless mat is adapted to wrap around and be rotated by said first and second elongated rollers;

a collection tray including:

a bottom wall;

two side walls;

wherein said two side walls of the collection tray are spaced from one another and are attached to and extend from said bottom wall of the collection tray;

two end walls;

wherein said two end walls of the collection tray are attached to and extend from opposite ends of said bottom wall of the collection tray and extend between said two side walls of the collection tray; and a top wall;

wherein said top wall of the collection tray is attached to one of said two end walls of the collection tray and to said two side walls of the collection tray and extends a distance to allow a space between a leading edge thereof and the other of said two end walls of the collection tray;

wherein said bottom wall, said two side walls, and said two end walls of the collection tray define an interior volume of the collection tray; and an elongated primary brush;

wherein said elongated primary brush has a length substantially equal to said width of said endless mat, is attached along a length of said leading edge of said top wall of said collection tray, and is adapted to contact said top surface of said endless mat as it is rotated by said first and second rollers, to thereby frictionally remove any dirt and debris retained upon said top surface of said endless mat, and adapted such that said removed dirt and debris would fall into and be removably retained within said interior volume of said collection tray;

wherein said collection tray is sized and adapted to be removably placed adjacent to and underneath said first elongated roller, such that said collection tray can be removed, dirt and debris removed therefrom, and then placed back into place adjacent to and underneath said first elongated roller.

2. The improved floor mat apparatus of claim 1, further comprising an elongated secondary brush that is spaced from said elongated primary brush and has a length substantially equal to said width of said endless mat; and wherein said elongated secondary brush is attached along a length of an interior surface of said bottom wall of said collection tray, and is adapted to contact said top surface of said endless mat as it is rotated by said first and second rollers, to thereby frictionally remove dirt and debris still retained upon said top surface of said endless mat after being brushed by said elongated primary brush, and adapted such that said removed dirt and debris would fall into and be removably retained within said interior volume of said collection tray.

3. The improved floor mat apparatus of claim 1, further comprising a removable panel removably connected to top edge portions of said two side walls at said respective distal end portions thereof, and adapted to cover and protect said interior volume of said main body in proximity to said first roller member and said collection tray while facilitating removal and replacement of said collection tray.

4. The improved floor mat apparatus of claim 3, wherein said removable panel is further pivotally connected to one of said two end walls located adjacent said proximal end portions of said two side walls.

5. The improved floor mat apparatus of claim 1, further comprising a vibrator electrically connected to said power source, is located within said interior volume adjacent said collection tray, is adapted to vibrate said collection tray when said first and second rollers are rotating said endless mat such that dirt and debris moves with said collection tray away from said endless mat.

6. The improved floor mat apparatus of claim 1, further comprising an ultraviolet light strip electrically connected to said power source, has a length substantially equal to said width of said endless mat, is located within said interior volume and attached to an inner surface of said bottom wall of said main body, and is adapted to sterilize said top surface of said endless mat.

7. The improved floor mat apparatus of claim 6, wherein said ultraviolet light strip is formed as a light emitting diode light strip.

8. The improved floor mat apparatus of claim 1, further comprising a control panel attached to a top edge portion of one of said two side walls, is electrically connected to said power source and said motor, and is adapted to tum on and off said motor and control the speed of rotation thereof.

9. The improved floor mat apparatus of claim 1, wherein said power source is formed as a rechargeable battery.

10. The improved floor mat apparatus of claim 1, further comprising an indicator light attached to a top edge portion of one of said two side walls, is electrically connected to said power source, and is adapted to indicate when power is being transferred to said motor.

11. The improved floor mat apparatus of claim 1, wherein said collection tray is formed from a plastic material.

12. The improved floor mat apparatus of claim 11, wherein said collection tray includes an inner layer of material adapted to kill germs.

13. The improved floor mat apparatus of claim 1, wherein said collection tray is formed from a cloth material.

14. The improved floor mat apparatus of claim 13, wherein said cloth material is formed from a hypoallergenic cloth material.

15. The improved floor mat apparatus of claim 1, wherein said main body is formed having dimensions including a width of between 16 and 18 inches.

* * * * *